United States Patent [19]

Saito

[11] Patent Number: 5,001,519

[45] Date of Patent: Mar. 19, 1991

[54] IMAGE FIXING APPARATUS HAVING PLURAL TEMPERATURE SETTINGS

[75] Inventor: Masashi Saito, Yokohama, Japan

[73] Assignee: Canon Kabushiki Kaisha, Tokyo, Japan

[21] Appl. No.: 314,797

[22] Filed: Feb. 24, 1989

[30] Foreign Application Priority Data

Feb. 29, 1988 [JP] Japan ..... 63-46894

[51] Int. Cl.[5] ..... G03G 15/20

[52] U.S. Cl. ..... 355/285; 355/290; 355/208; 219/216

[58] Field of Search ..... 355/206, 208, 285, 289, 355/290, 311; 219/216; 432/60

[56] References Cited

FOREIGN PATENT DOCUMENTS 61-126585 6/1986 Japan ..... 355/285

62-206581 9/1987 Japan ..... 355/285

*Primary Examiner*—Joan H. Pendegrass

*Attorney, Agent, or Firm*—Fitzpatrick, Cella, Harper & Scinto

[57] ABSTRACT

An image fixing apparatus includes a pair of rotatable members, the pair comprising a heating rotatable member and a back-up rotatable member press-contacted to the heating rotatable member, wherein the heating rotatable member is settable at a first setting temperature and a second setting temperature which is lower than the first setting temperature, when an image fixing operation is performed; a control system for controlling rotation of the pairs of rotatable members, the control system rotating the pairs of rotatable members when the setting temperature of the heating rotatable member is changed from the first setting temperature to the second setting temperature.

23 Claims, 1 Drawing Sheet

IMAGE FIXING APPARATUS HAVING PLURAL TEMPERATURE SETTINGS

FIELD OF THE INVENTION AND RELATED ART

The present invention relates to an image fixing apparatus usable with an image forming apparatus such as a copying apparatus or a laser beam printer and, more particularly, to an image fixing apparatus wherein an unfixed image is fixed by applying heat thereto by a heating rotatable member.

Recently, an image fixing apparatus has been widely used wherein an image supporting material containing an unfixed image is passed through a nip formed between two rotatable members, while heat and pressure are applied to the unfixed image to fix it. Because of the size of the apparatus and the fixing property it is considered that the setting temperature of the heating rotatable member is changed depending on the materials of the image supporting material or the like.

Various image forming machines have been put into practice wherein full color image or plural color images are produced. In an the apparatus of this kind, in order to provide a full color or a multi-color image, there is provided a plurality of developing devices for developing latent images formed on a photosensitive drum for the respective colors, and each developing device is exchanged with another one containing different toner, so as to provide full color image or a multi-color image. In this case, the toners having different colors have different proper image fixing temperatures due to the difference in materials constituting the toners. Take for example, an electrophotographic copying apparatus wherein a black color developing device is exchanged with a non-black monochromatic color developing device to develop respective latent images on the photosensitive. The monochromatic toner does not contain magnetic material so as to provide bright color, whereas the black toner is a one component magnetic toner containing magnetic material since the structure of the developing device is simpler and since the maintenance is easier. It is noted that because the black toner contains magnetic material, the proper fixing temperature for the black toner is higher than that of the non-black monochromatic toner. Depending on the material of the resin constituting the toner and on the content of the magnetic material or the like, the temperature difference can be as large as several tens of degrees.

Therefore it is considered that the setting temperature of the heating rotatable member is changed in accordance with the material of the toner used.

However, a change of the setting temperature involves a problem that a long period of time is required for the temperature to decrease sufficiently when amount of the change is large. Japanese Laid-Open Patent Application No. 115072/1980 proposes provision of a cooling device so as to quickly change the temperature. However, the Japanese Laid-Open Application does not disclose which temperature is intended and does not disclose use with a heating rotatable member.

SUMMARY OF THE INVENTION

Accordingly, it is an object of the present invention to provide an image fixing apparatus wherein the setting temperature of the heating rotatable member can be changed quickly.

It is another object of the present invention to provide an image fixing apparatus wherein the temperature of the heating rotatable member can be decreased quickly without use of an additional cooling mechanism.

It is a further object of the present invention to provide an image fixing apparatus wherein toner images formed of different toners can be fixed without high temperature off-set and low temperature off-set.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
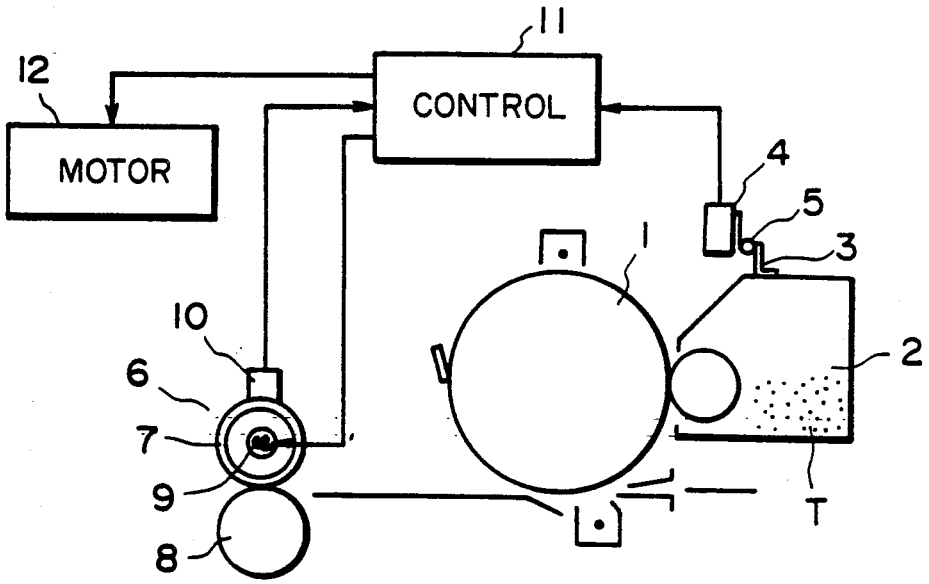
FIG. 1 is a sectional view of an image fixing apparatus according to an embodiment of the present invention.

Referring now to FIG. 1, there is shown an electrophotographic copying apparatus as an exemplary image forming apparatus using an image fixing apparatus according to an embodiment of the present invention. The image forming apparatus comprises a photosensitive drum 1 and various known means therearound, such as a charging device, an exposure device, a developing device, an image transfer device and a cleaning device.

The developing device is replaceable with another developing device containing different toner. By the interchange of the developing device, the image forming operation is possible with different color toners.

A predetermined image processing operation is performed by the various devices disposed around the photosensitive drum 1, and the latent image formed on the surface of the photosensitive drum 1 is developed by the developing device 2 disposed close to the photosensitive drum 1. The developing device 2 contains toner T therein and is provided with a lever 3 fixed thereto at a proper position on the top surface thereof, in this embodiment. The position of the lever 3 on the top surface of the developing device 2 is different depending on the material of the toner T contained in the developing device. When a developing device is mounted into the image forming apparatus at a proper position determined for the respective developing devices, the lever 3 of the developing device closes a contact 5 of a microswitch 4 disposed at a proper position in association with the material of the toner. The number of the microswitches 4 disposed at the proper positions in the apparatus may be one or plural depending on the number of toners T usable with the apparatus.

By the developing device 2, the latent image formed on the surface of the photosensitive drum 1 is developed into a toner image, which is, in turn, transferred onto an image supporting material such as paper or the like, fed to the photosensitive member. Thereafter, the image is fixed by a heating fixing apparatus 6 provided in the image forming apparatus.

The image fixing apparatus 6 comprises an fixing roller 7 contactable with the unfixed toner image and a back-up or pressing roller 8. The fixing roller 7 contains therein a heater 9 and is provided with a thermister 10 for detecting an image fixing temperature.

When the developing device 2 is mounted in the developing device accommodating position on the image fixing apparatus, when the lever 3 close the contact 5 of the microswitch 4 disposed at the proper position of the image forming apparatus depending on the material of the toner T contained in the developing device. A signal produced by the close of the contact 5 is transmitted to a control unit 11 so that the material of the toner is discriminated. The control unit 11 is supplied with a temperature detection signal from the thermister 10 of the heating fixing apparatus 6 for detecting the temperature of the fixing roller 7. In response to the temperature detection signal, the control unit 11 produces a control or energization signal to the heater 9 of the fixing roller 7, thus on-off-controlling the heater 9 to properly heat the fixing roller 7.

In the control device, a change in the resistance for the temperature detection by the thermister 10 is converted to a voltage change, and the changed voltage is compared with a reference voltage signal corresponding to the setting temperature. The control signal is such that when the temperature detected by the thermister 10 is lower than the setting temperature, the heater 9 is energized, whereas when the temperature detected by the thermister 10 is higher than the setting temperature, the heater 9 is deenergized, thus maintaining the temperature of the fixing roller 9.

In this case, the control unit 11 has reference voltages properly predetermined for respective toners, and proper one of the reference voltages is selected corresponding to the material of the toner detected by the lever 3. Thus, by changing the reference voltage, the setting temperature of the fixing roller 7 can be changed properly. The control unit 11 comprises instruction means.

When a developing device containing a black magnetic toner is set in the apparatus, the fact that it contains the black toner is detected, and in response to the detection, the control unit 11 selects 180° C. as the setting temperature of the fixing roller 9. Thereafter, the currently set developing device is interchanged with a monochromatic color developing device containing a non-magnetic monochromatic color toner. Then, the fact that the new developing device contains the color toner is detected, and in response to the detection signal, the control unit 11 changes the setting temperature from 180° C. for the black toner to 155° C. lower than it, and it deenergizes the heater 9 and actuates a driving motor 12 for rotating the fixing roller 7. By the rotation of the fixing roller 7, the pressing roller 8 rotates following the fixing roller 7. By the rotation of the pressing roller 8 in contact with the fixing roller 7, the fixing roller 7 is forcedly cooled.

When the thermister 10 detects that the surface temperature of the fixing roller 7 reaches the color toner setting temperature, that is, 155° C., the rotation of the fixing roller stops, and the apparatus is prepared for the image forming operation. When an image formation signal is produced, the image is formed with the color toner.

The rotations of the fixing roller 7 and the pressing roller 8 for forcedly cooling the fixing roller 7 are preferably performed when the surface temperature of the fixing roller 7 is higher than the new setting temperature.

Therefore, if a substantial time is required for the exchange from the black developing device to the color developing device to such an extent that the surface temperature of the image fixing roller 7 decreases to a temperature which is not higher than the color toner setting temperature, the roller rotations for the force cooling are not required. The rotations of the rollers for the force cooling are effected in accordance both with the signal instructing the change of the setting temperature and the current surface temperature of the roller.

On the other hand, when the color developing device is exchanged to the black developing device, the setting temperature is increased, and therefore, the roller rotation for the forced cooling is not performed.

Experiments have been performed with a copying machine capable of producing 15 copies/min. in a one-to-one magnification for A3 size, provided with a heating roller type fixing apparatus having 900 W heater and a PTFE fixing roller having a diameter of 32 mm and a thickness of 25 mm. In this apparatus, the fixing setting temperature for a black one component magnetic toner is approximately 180° C. to provide good image fixing property without toner offset is 180° C., whereas the proper setting temperature for a non-magnetic monochromatic color toner was approximately 155° C. When the black developing device is exchanged with a color toner developing device, it took approximately 150 sec. when the fixing apparatus was left as it was when the room temperature was approximately 25° C.

When the fixing roller and the pressing roller were rotated until the temperature decreases sufficiently, it took only approximately 40 sec. for the surface temperature decreases 180° C. to 155° C. when the room temperature was approximately 25° C.

Therefore, the waiting period is reduced to approximately one fourth.

Figure 2:
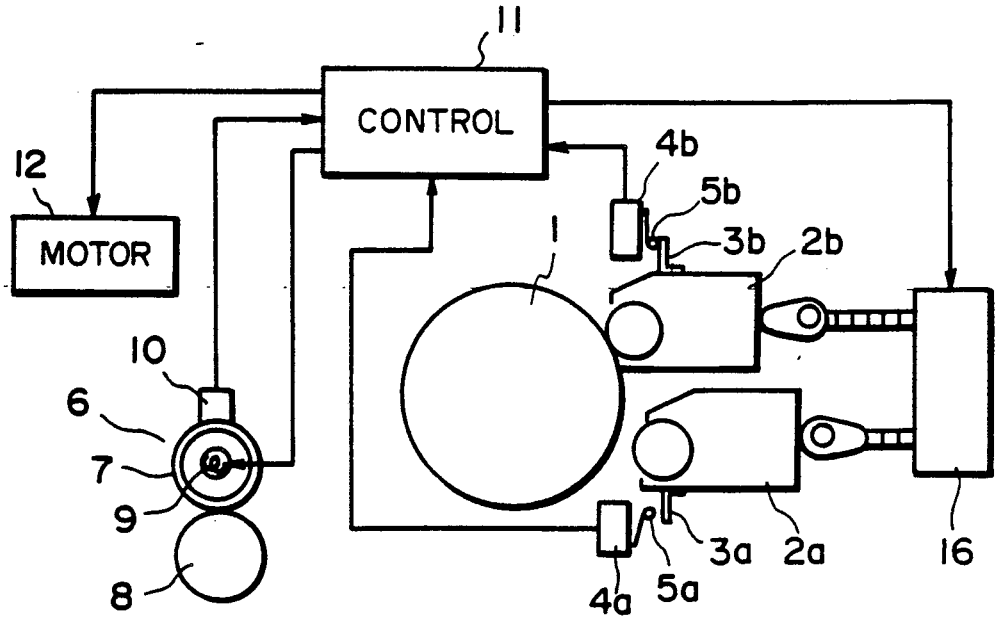
FIG. 2 is a sectional view of an image fixing apparatus according to another embodiment of the present invention.

Referring to FIG. 2, another embodiment of the present invention will be described. In this embodiment, the image forming apparatus contains a developing device **2*a* containing a black one component magnetic toner and a developing device 2*b* containing a red non-magnetic toner. Those developing devices 2*a* and 2*b* are urged away from the photosensitive drum 1, and are selectively placed close to or in contact with the photosensitive drum 1 by a cam driving unit 16. By the cooperation among the levers 3*a* and 3*b*, microswitches 4*a* and 4*b* and contacts thereof 5*a* and 5*b***, the discrimination is made as to which developing device is operable, and in response to the discrimination, the heating roller setting temperature is determined.

The present invention wherein the heating roller is forced cooled by rotation of the rollers is particularly advantageous when it is used with the image forming apparatus containing plural developing devices, because the developing device can be quickly interchanged.

As described in the foregoing, according to the present invention, the temperature of the heating roller can be decreased quickly without necessity of a particular cooling means. In addition, since the rollers are rotated for the cooling, the temperature of the entire surface of the roller is made uniform so that the non-uniform image fixing is produced.

In the foregoing description, a roller is taken as an Example of the rotatable member, but the rotatable member may be in the form of a belt or the like.

In addition, the change of the setting temperature is not limited to that depending on the material of the toner, but may be depending on the material of the toner image supporting material or another.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a pair of rotatable members, said pair comprising a heating rotatable member and a back-up rotatable member press-contacted to the heating rotatable member;

temperature control means for controlling a surface temperature of said heat ratable member selectively at a first temperature and a second temperature which is lower than the first temperature in an image fixing operation;

rotation control means for controlling rotation of said pair of rotatable member when the second temperature is selected, wherein said rotation control means causes said pair of rotatable members to rotate until the temperature of the surface reaches the second temperature.

2. An apparatus according to claim 1, further comprising instruction means for instructing change of the temperature, wherein an output from said instruction means is supplied to said control means.

3. An apparatus according to claim 2, wherein when the instruction means produces an output for change from the second temperature to the first temperature, said rotation control means does not rotate said pair of rotatable members even when it is given the instruction signals for the change from the second temperature to the first temperature.

4. An apparatus according to claim 2, further comprising a heating source for heating said heating rotatable member, and said temperature control means controlling heat generation of the heating source in response to an output of said instruction means.

5. An apparatus according to claim 4, wherein said temperature control means deenergizes the heating source when it receives from said instruction means a signal indicative of change from the first temperature to the second temperature.

6. An apparatus according to claim 4, further comprising means for detecting temperature of said rotatable member, wherein when said instruction means produces an output indicative of temperature change from the first temperature to the second temperature, said rotation control means does not rotate said pair of rotatable members if the temperature of said heating rotatable member is not higher than the second setting temperature.

7. An image forming apparatus capable of image formation with a first developer and of image formation with a second developer which is different from said first developer, comprising:

a pair of rotatable members, the pair comprising a heating rotatable member and a back-up rotatable member press-contacted to said heating rotatable member, said heating rotatable member being set at a first temperature when it fixes an image formed with the first developer, and being set at a second temperature when it fixes an image formed with the second developer;

rotation control means for controlling rotation of said pair of rotatable members, wherein when the temperature of a surface of said heating rotatable member is changed from the first temperature to the second temperature, said rotation control means causes said pair of rotatable members to rotate until the temperature of the surface reaches the second temperature.

8. An apparatus according to claim 7, wherein the first developer is a magnetic toner, and the second developer is a non-magnetic toner.

9. An apparatus according to claim 8, wherein the first developer contains a black toner, and the second developer contains monochromatic color toner.

10. An apparatus according to claim 7, further comprising instruction means for instructing change of the temperature, wherein an output from said instruction means is supplied to said rotation control means.

11. An apparatus according to claim 10, wherein when the instruction means produces an output for change from the second setting temperature to the first temperature, said control means does not rotate said pairs of rotatable members even when it is given the instruction signals for the change from the second temperature to the first temperature.

12. An apparatus according to claim 10, further comprising a heating source for heating said heating rotatable member, and second control means for controlling heat generation of the heating source, wherein said second control means controls heat generation of the heating source in response to an output of said instruction means.

13. An apparatus according to claim 10, wherein said second control means deenergizes the heating source when it receives from said instruction means a signal indicative of change from the first temperature to the second temperature.

14. An apparatus according to claim 10, further comprising means for detecting temperature of said rotatable member, wherein when said instruction means produces an output indicative of temperature change from the first temperature to the second temperature, said first control means does not rotate said pair of rotatable members if the temperature of said heating rotatable member is not higher than the second setting temperature.

15. An apparatus according to claim 7, wherein the first developing device and the second developing device are interchangeable, and the setting temperature for the heating rotatable member is determined on the basis of a detection of one of said first and second developing devices to be developed.

16. An image forming apparatus, comprising:

an image bearing member;

first and second developing means for forming developed images on said image bearing member with different developers;

means for transferring the developed images onto recording material;

a pair of rotatable members, said pair comprising a heating rotatable member and a back-up rotatable member press-contacted to said heating rotatable member, said heating rotatable member being settable at a first temperature when it fixes the developed image formed by said first developing means and a second temperature which is lower than the first temperature when it fixes the image formed by said second developing means;

first control means for controlling rotation of said pairs of rotatable members, wherein when the temperature of the surface is changed from the first temperature to the second temperature, said rotation control means causes said pair of rotatable members to rotate until the temperature of the surface reaches the second temperature.

17. An apparatus according to claim 16, wherein the first developer is a magnetic toner, and the second developer is a non-magnetic toner.

18. An apparatus according to claim 17, wherein the first developer contains a black toner, and the second developer contains monochromatic color toner.

19. An apparatus according to claim 16, further comprising instruction means for instructing change of the setting temperature, wherein an output from said instruction means is supplied to said control means.

20. An apparatus according to claim 19, wherein when the instruction means produces an output for change from the second setting temperature to the first setting temperature, said control means does not rotate said pairs of rotatable members even when it is given the instruction signals for the change from the second temperature to the first temperature.

21. An apparatus according to claim 19, further comprising a heating source for heating said heating rotatable member, and second control means for controlling heat generation of the heating source, wherein said second control means controls heat generation of the heating source in response to an output of said instruction means.

22. An apparatus according to claim 19, wherein said second control means deenergizes the heating source when it receives from said instruction means a signal indicative of change from the first temperature to the second temperature.

23. An apparatus according to claim 19, further comprising means for detecting temperature of said rotatable member, wherein when said instruction means produces an output indicative of temperature change from the first temperature to the second temperature, said first control means does not rotate said pair of rotatable members if the temperature of said heating rotatable member is not higher than the second setting temperature.

* * * * *

UNITED STATES PATENT AND TRADEMARK OFFICE

CERTIFICATE OF CORRECTION

PATENT NO. : 5,001,519

DATED : March 19, 1991

INVENTOR(S) : Masashi Saito

It is certified that error appears in the above-identified patent and that said Letters Patent is hereby corrected as shown below:

Column 1, line 39, "tosensitive" should read --tosensitive drum--.

Column 5, line 18, "heat ratable member" should read --heat-rotatable member--;

line 31, "control means." should read --rotation control means.--.

Signed and Sealed this

Fifth Day of January, 1993

*Attest:*

DOUGLAS B. COMER

*Attesting Officer*

*Acting Commissioner of Patents and Trademarks*